US007000796B2

(12) United States Patent
Goritzka et al.

(10) Patent No.: US 7,000,796 B2
(45) Date of Patent: Feb. 21, 2006

(54) REFUSE CONTAINER

(75) Inventors: Dirk Goritzka, Greifenstein (DE); Friedrich-Ernst Weller, Sinn (DE); Udo Thielking, Dietzhölztal (DE)

(73) Assignee: Hailo-Werk Rudolf Loh GmbH & Co., Haiger (DE)

( * ) Notice: Subject to any disclaimer, the term of this patent is extended or adjusted under 35 U.S.C. 154(b) by 58 days.

(21) Appl. No.: 10/431,451

(22) Filed: May 8, 2003

(65) Prior Publication Data

US 2004/0222225 A1 Nov. 11, 2004

(30) Foreign Application Priority Data

Apr. 8, 2003 (DE) ..... 103 15 975

(51) Int. Cl.
*B65D 43/26* (2006.01)

(52) U.S. Cl. ..... 220/263; 220/264; 220/908; 220/826; 220/830

(58) Field of Classification Search ..... 220/908, 220/260, 262–264, 826, 830, 8, 666, 23.87, 220/23.89; 49/263
See application file for complete search history.

(56) References Cited

U.S. PATENT DOCUMENTS

| | | | | |
|---|---|---|---|---|
| 1,053,688 A | | 2/1913 | Willcox | |
| 1,229,777 A | | 6/1917 | Oberholtzer | |
| 1,481,922 A | * | 1/1924 | Miller | 220/264 |
| 1,515,989 A | | 11/1924 | Banes | |
| 2,408,132 A | * | 9/1946 | Weeks | 296/223 |
| 2,419,163 A | * | 4/1947 | Pope, Sr. | 220/23.87 |
| 2,465,839 A | * | 3/1949 | Bloomfield | 100/228 |
| 3,389,826 A | * | 6/1968 | Wall | 220/264 |
| 5,350,079 A | * | 9/1994 | Larson et al. | 220/264 |
| 6,626,317 B1 | * | 9/2003 | Pfiefer et al. | 220/263 |
| 2004/0004080 A1 | * | 1/2004 | Yang et al. | |

FOREIGN PATENT DOCUMENTS

| | | |
|---|---|---|
| DE | 17 17 219 | 2/1956 |
| DE | 1 283 741 | 11/1968 |
| DE | 27 11 552 | 9/1978 |
| DE | 199 50 468 | 5/2001 |
| DE | 100 11 826 | 9/2001 |

* cited by examiner

*Primary Examiner*—Robin A. Hylton
(74) *Attorney, Agent, or Firm*—Hoffman, Wasson & Gitler, P.C.

(57) ABSTRACT

A refuse receptacle has an outer container with a lid closing an insertion opening in the upper region. A foot pedal is attached to the refuse receptacle and the actuation of which enables the lid of the refuse receptacle to be moved into an opening position. The foot pedal is of annular design and encircles the outer container and being arranged in the lower region thereof. The foot pedal is designed in a manner such that it can be depressed in a linear movement in order to open the lid, and an outer housing, which is connected to the foot pedal, or a casing of the refuse receptacle being able to be depressed together with the foot pedal.

18 Claims, 9 Drawing Sheets

REFUSE CONTAINER

BACKGROUND OF THE INVENTION

The present invention relates to a refuse receptacle having an outer container with a lid closing an insertion opening in the upper region, including a foot pedal which is attached to the refuse receptacle and the actuation of which enables the lid of the refuse receptacle to be moved into an opening position, the foot pedal being of annular design and running at a distance around the outer container and being arranged in the lower region thereof.

U.S. Pat. No. 1,229,777 describes a refuse receptacle of the generic type mentioned at the beginning. In this known refuse receptacle; an essentially cylindrical outer housing is provided and the foot pedal for opening the lid is annular and runs at a little distance around the outer housing in the lower region thereof. However, this annular foot pedal is mounted in an articulated manner at two points on the outer housing and is therefore pressed down on one side in order to open the lid, said foot pedal then moving upward in the region lying 180° opposite, when viewed on the circumference of the outer housing. It is thus a pivoting movement about two pivot points having an imaginary, horizontal pivot axis which extends radially through the refuse receptacle. The opening of the lid takes place via rods which, when the foot pedal is depressed in the front region, are raised in the rear region of the lid owing to the pivoting movement and then use their upper end to raise the lid. In this design, the opening of the foot pedal can only take place by treading down the front half-ring, which lies in front of the two pivot points. The foot pedal cannot be depressed at all in the region of the pivot points. On the rear half-ring on the other side of the pivot points, opening of the lid would theoretically be possible just by raising the foot pedal with the foot, but this is not envisaged. It follows from this that, in this design of the foot pedal, the opening is envisaged only approximately in the front, central region of the annular foot pedal lying between the two pivot points. The pivotable mounting in the region of the two pivot points means that a linear depression of the foot pedal is not possible. The applicant's earlier patent application DE 101 55 942.9, which has not been published before the date of the present application and was applied for on Nov. 14, 2001, describes a refuse receptacle having an annular foot pedal in which it is in principle possible to depress the foot pedal in an approximately linear movement in order to open a lid of the refuse receptacle. This has the advantage that the foot pedal can be trodden down at any desired point of its circumference in order to open the lid. In this known design, the ring of the foot pedal is mounted at a number of points, as viewed over the circumference, and movable actuating elements are mounted on the foot pedal and, when the latter is depressed, reach under the bottom of an inner container of the refuse receptacle and raise said container. The outer container of the refuse receptacle retains its position. Lifting of the inner receptacle ultimately causes the lid to be raised. This solution has proven less suitable for mass production.

The object of the present invention is to provide a refuse receptacle of the generic type mentioned at the beginning, in which the foot pedal can be depressed from any desired point of the circumference, and structurally simple manufacturing is possible and is suitable for mass production. This object is achieved by a novel refuse receptacle of the generic type mentioned at the beginning having the defining features of the main claim. The invention makes provision for the foot pedal to be designed in a manner such that it can be depressed in a linear movement in order to open the lid, with, however, unlike in the previously mentioned design from the earlier application which has not been published before the date of the present application, an outer housing, which is connected to the foot pedal, or a casing of the refuse receptacle being depressed together with the foot pedal. In order to ensure a guided, linear movement when the outer housing or casing of the refuse receptacle is depressed, corresponding guide means are preferably provided. A very wide variety of guide means are suitable here. In particular, guide elements, such as guide rods, guide tubes or the like, can be attached to the outer housing or casing of the refuse receptacle or can be connected to the latter. These are preferably furthermore assigned guide elements, which interact with the guide means attached to the outer housing or casing of the refuse receptacle. All guide means or guide elements, which ensure good linear guidance and prevent tilting of the outer housing as it is being depressed, are suitable here. For example, guide tubes or sleeves are possible in which guide rods move, the guide rods being attached to the outer housing or vice versa.

SUMMARY OF THE INVENTION

The refuse receptacle preferably has a base and the outer housing or the casing can be pushed over this base or can also be pushed into this base, as a result of which additional guidance can be achieved, if appropriate. In this design, there is therefore a fixed base which stands on the underlying surface, and the outer housing or the casing is displaced linearly downward relative to the base by the foot pedal, when the latter is actuated, with the outer housing or the casing preferably moving back automatically into the original position when the foot pedal is released. This preferably therefore involves a stroke-type movement, which takes place counter to the force of a spring-loaded cylinder. One substantial advantage of the refuse receptacle according to the invention resides in the fact that the point on the circumference of the approximately annular foot pedal, on which the foot treads in order to depress the refuse receptacle and thus to open the lid, is in principle as desired. In addition, the design according to the invention is more robust than in the case of using linkages which are mounted in an articulated manner on the foot pedal and, as a rule, have to be deflected a number of times, and which, in the process, have to exert a force which raises the inside bin. Considerable forces are necessary for this, in particular if the inside bin has been filled, with the result there is the risk of a linkage of this type being distorted or wear on the linkage or in the region of the joints occurring in some form or other. In contrast, the solution according to the invention has the advantage that the force does not need to be deflected. Rather, the force acts from above on the foot pedal as it is being depressed and is transmitted to the outer housing or the casing. This thus involves a linear, guided movement in which the opening of the lid is brought about by parts, for example, of the guide means which do not join in with this depressing movement and, as a result, can reach directly or indirectly below parts of the lid in order thus to raise the latter. A preferred structural solution makes provision for parts of the guide means to be designed in a manner such that they are fixed and can be displaced relative to parts of the lid or lid segments as the outer housing of the refuse receptacle is being depressed, and for these fixed parts, as the outer housing is being depressed, to press at a suitable point below the lid or lid segments in order to raise them. This pressure on the lid or lid segments preferably takes place in such a manner that they execute a pivoting movement. It is possible, for example, to let the guide means or the fixed parts engage on the lid or the lid segments at a distance from the pivot axis, in order to obtain a lever effect. A particularly preferred solution makes provision, on the one hand, as the outer housing or casing of the refuse receptacle is being depressed, for fixed parts to reach below the lid or lid segments and push them up and, at the same time, to pull outer regions of the lid or lid segments downward together with the depressing outer housing via "driver elements", as a result of which the pivoting movement of the lid or lid segments is triggered. The said fixed parts, which do not move downward during depressing of the outer housing, do not absolutely have to be parts of the guide means. It is merely an advantage if these parts are of rod-shaped or tubular design and are additionally used as guide means for a guided, linear depressing movement of the outer housing.

Further advantages emerge from the structural detailed solutions, a number of which will be explained in the following. For example, in order to fasten the annular foot pedal to the outer housing or casing of the refuse receptacle, use may be made of an inner ring which is an annular part which bears against the inside of the outer housing, with the result that the annular foot pedal can be secured there, for example via fastening means, for example can be screwed on. A fastening of this type is simpler than fastening it solely to the outer housing, which may be a casing having a relatively thin wall thickness.

As the spring-loaded cylinder for the corresponding return movement, i.e. the raising again of the outer housing into the initial position, it is appropriate to use springs, in particular compression springs, which are stressed when the outer housing is depressed. Compression springs of this type may, for example, be arranged in the region of the guide means. An inner ring of this type can then be used at the same time for the guide means. In addition to an inner ring of this type, which is attached to the inside of the outer housing level with the foot pedal, a further inner ring may be attached in the upper region, said inner ring firstly providing further guiding possibilities and the possibility of fastening further parts required, for example, for the securing and articulated mounting of the lid segments or of the lid.

A refuse receptacle according to the invention furthermore preferably comprises an outer ring, i.e. an upper part, which is placed onto the upper side of the outer housing and closes the latter upward and can fit over the outer housing. In order to fasten an outer ring of this type, use can be made of a further, annular part, in particular a covering ring, which can be pushed in the upper region onto the outer housing of the refuse receptacle and is used for fastening the outer ring. A form-fitting and/or frictional connection between the covering ring and the outer ring can be used for this. The lid or the lid segments can then be mounted in an articulated manner on the outer ring. If the outer housing of the refuse receptacle is depressed by treading down the foot pedal, the outer ring of the refuse receptacle preferably remains in its original position. Since the outer ring forms the upper end of the refuse receptacle, although the casing or the outer housing is depressed relative to the base, the overall height of the refuse receptacle remains visually unchanged, since the action merely pushes the outer housing in the lower region further over the base and in the upper region takes away the overlap of the outer ring, which fits over the outer housing, from the outer housing. The abovementioned, fixed parts, which may also be used as guide means, can be held in each case on their end sides in the base, on the one hand, and in the outer ring, on the other hand. If use is therefore made, for example, of guide rods or guide tubes or similar elongate guide means which can be fixed in their position and can protrude on the upper side into the outer ring and on the lower side into the base, then good linear guidance can be ensured by the inner rings or by other guide elements, which are fastened or are integrally formed on the inside of the outer housing or casing and through which the said fixed guide means extend.

The actual container which receives the refuse is preferably an inside bin which is placed into the outer housing or the casing and can preferably be removed in order to be emptied. Provision may be made for the outer ring to be taken off from the outer housing in order to remove the inside bin.

The pivot axis of the lid or of the lid parts or lid segments preferably run horizontally in the outer region, and preferably continue approximately tangentially with respect to the outer housing. It is particularly preferred for the lid to be divided into a number of lid segments made up to 360°, with it being possible for there to be, for example, three lid segments having an outer circumference of approximately 120°, which pivot about their horizontal axis, which lies in the outer region, as the outer housing is being depressed. In the opened position, these lid segments are preferably approximately vertical or they even pivot further outward beyond the vertical, resulting in a large insertion opening in which the entire cross section of the opening of the inside bin can be made available for the insertion of the refuse. The features mentioned in the subclaims relate to preferred developments of the achievement by the invention of the object. Further advantages of the invention emerge from the following detailed description.

BRIEF DESCRIPTION OF THE DRAWINGS

The present invention will be described in greater detail below using exemplary embodiments with reference to the attached drawings, in which.

DETAILED DESCRIPTION OF THE INVENTION

Figure 1:
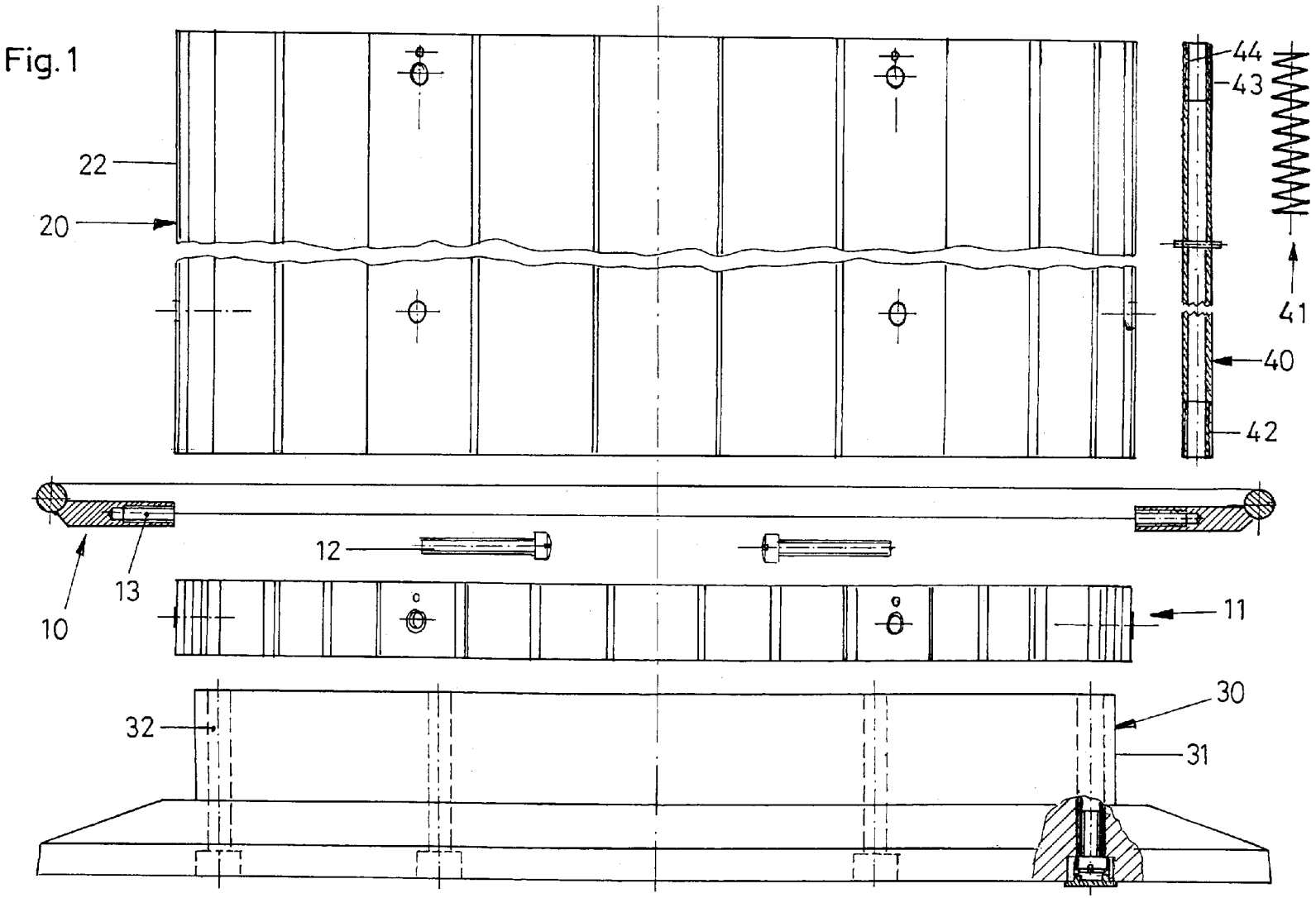
FIG. 1 shows an exploded illustration in the lower region of the refuse receptacle, in a partial section.
Figure 2:
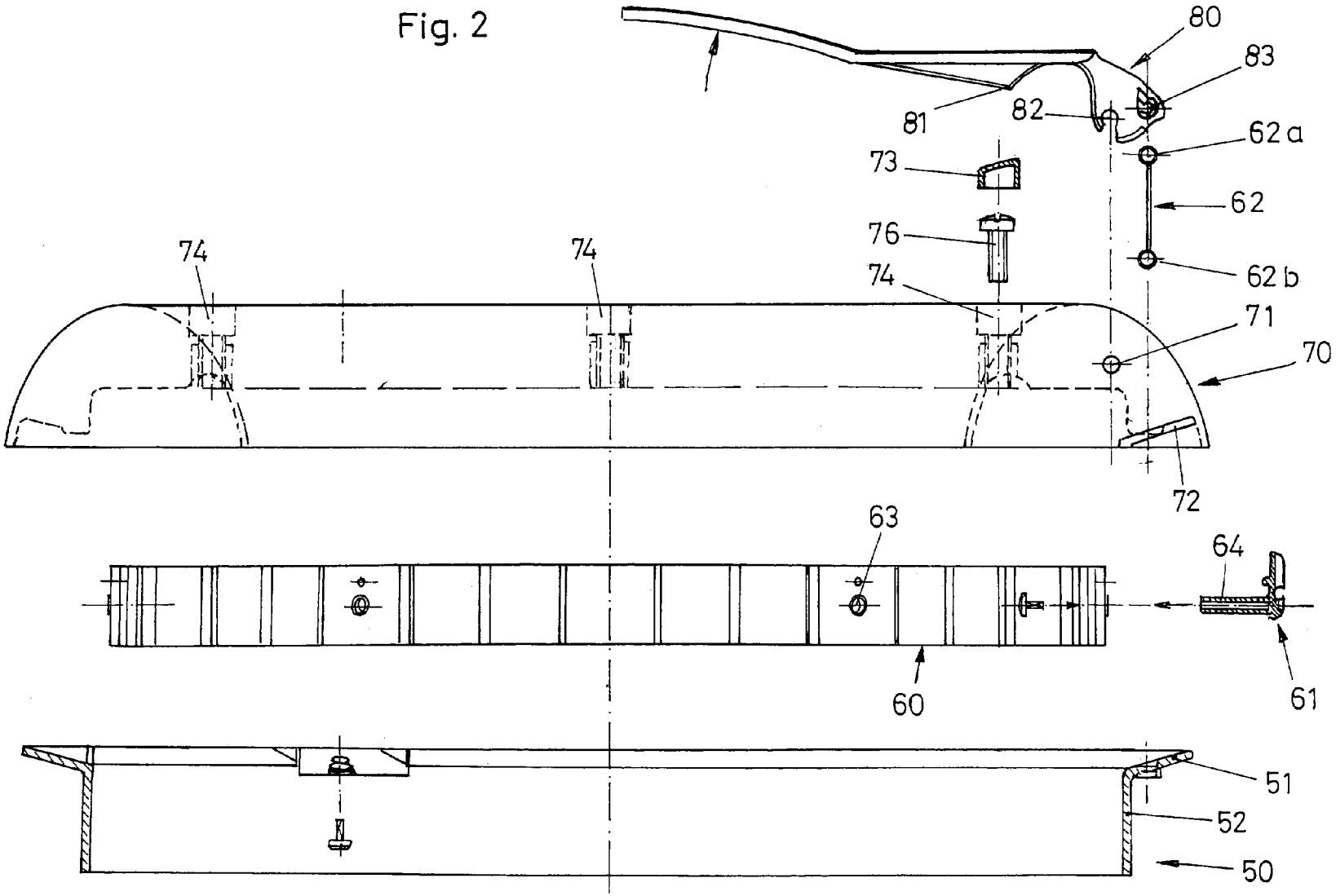
FIG. 2 shows an exploded illustration supplementing the illustration of FIG. 1 in the upper region of the refuse receptacle.

Reference is made to FIGS. 1 and 2. The refuse receptacle according to the invention comprises a base 30 with which it stands on the underlying surface. Furthermore, an outer housing 20 in the form of a casing is provided with an annular foot pedal 10 fastened to it, by means of which the depressing movement takes place when the lid of the refuse receptacle is to be opened. When the foot pedal 10 is depressed, the latter moves the outer housing 20 downward. This involves a linear stroke-type movement of the outer housing, for which a guide is provided. This guide comprises guide tubes 40 which are accommodated in the outer housing 20 in a manner such that they are distributed at a number of points over the circumference, said guide tubes being pushed into guide sleeves 65 of an inner ring 60, which is fastened to the outer housing 20, and being guided in said guide sleeves 65 as the outer housing 20 is being depressed or raised. The refuse receptacle furthermore comprises a covering ring 50, the inner ring 60 and an outer ring 70, this outer ring 70 forming the upper end of the housing of the refuse receptacle and, in addition, a number of segments 80 of the lid being attached in an articulated manner to the outer ring 70. When the foot pedal 10 is actuated and the outer housing 20 depressed, these lid segments 80 are pivoted outward about a horizontal pivot axis in the direction of the arrow, thus producing a central insertion opening in the upper region for the refuse receptacle. There may be a number of these lid segments 80 which are distributed over the circumference and made up in total such that they approximately form a circular arrangement, for example there may be three lid segments which then, as seen in each case in plan view, are approximately in the shape of a 120° sector of a circle.

The covering ring 50 has an upper, obliquely outwardly directed collar 51, which engages in a groove 72 of the outer ring, said groove being correspondingly shaped, with the result that a virtually form-fitting connection is produced. Furthermore, springs 41 which are compressed during the depressing movement of the outer housing 20 are provided on the axis of the guide tubes 40. These springs 41, for example, compression springs, are then used to deliver a restoring force for this, so that when the foot pedal 10 is released, the outer housing 20 moves back upward again into the initial position.

The opening mechanism of the refuse receptacle according to the invention is as follows. The annular foot pedal 10 can be used to exert a force, in principle at any desired point on the circumference, which results in the outer housing 20 being depressed, with the guide rods 21 being displaced in the guide sleeves 65 and the springs 41 being stressed. The outer wall 22 of the outer housing 20 is displaced in the process relative to the cylindrical stem 31 of the base 30. The guide tubes 40 are made longer than the height of the outer housing 20 and engage in their lower end region 42 into drilled holes 32 in the cylindrical part 31 of the base 30. If the outer housing 20 is depressed, the inner ring 60 is also lowered together with it whereas the covering ring 50 and the outer ring 70, which is connected in turn to the latter via the collar 51 and the groove 72, remain in the original position. The outer housing and inner ring are thus displaced relative to the base 30 and also relative to the guide tubes 40, which are secured on their end side in the base, with the result that the upper end regions 43 of the guide tubes 40 then likewise carry out a displacement movement relative to the outer housing 20. The upper end regions 43 engage on the upper side in covering caps 73 and are secured in receiving sleeves 74 of the outer ring 70. The lower end of the driver elements 62 is attached to the retaining clips 61 which are secured in turn in the drilled holes 63 of the inner ring 60 via their stem 64. As a result, when the inner ring is depressed the driver elements 62 are moved downward at the same time. The upper end 62*a* is secured in an articulated manner at the points of articulation 83 on the respective lid segment 80. The depressing of the inner ring 60 together with the outer housing 20 causes the driver elements 62 to be pulled downward and they therefore exert, via the points of articulation 83, a tensile force on the lid segments 80, which enables said lid segments to pivot about the axis of the joint formation 82. The lid segments therefore pivot about the horizontal axis 71, since they are fastened pivotably there by means of their joint formation 82 in the outer ring 70. The lid segments 80 therefore swing outward about the outer pivot axis 71, with the result that then a central insertion opening for the refuse is produced. If the foot pedal 10 is released, the latter moves upward again and the outer housing 20 also moves together with the foot pedal, this movement back being brought about by the restoring force of the springs 41 which move the outer housing 20 back upward into the initial position.

Figure 3:
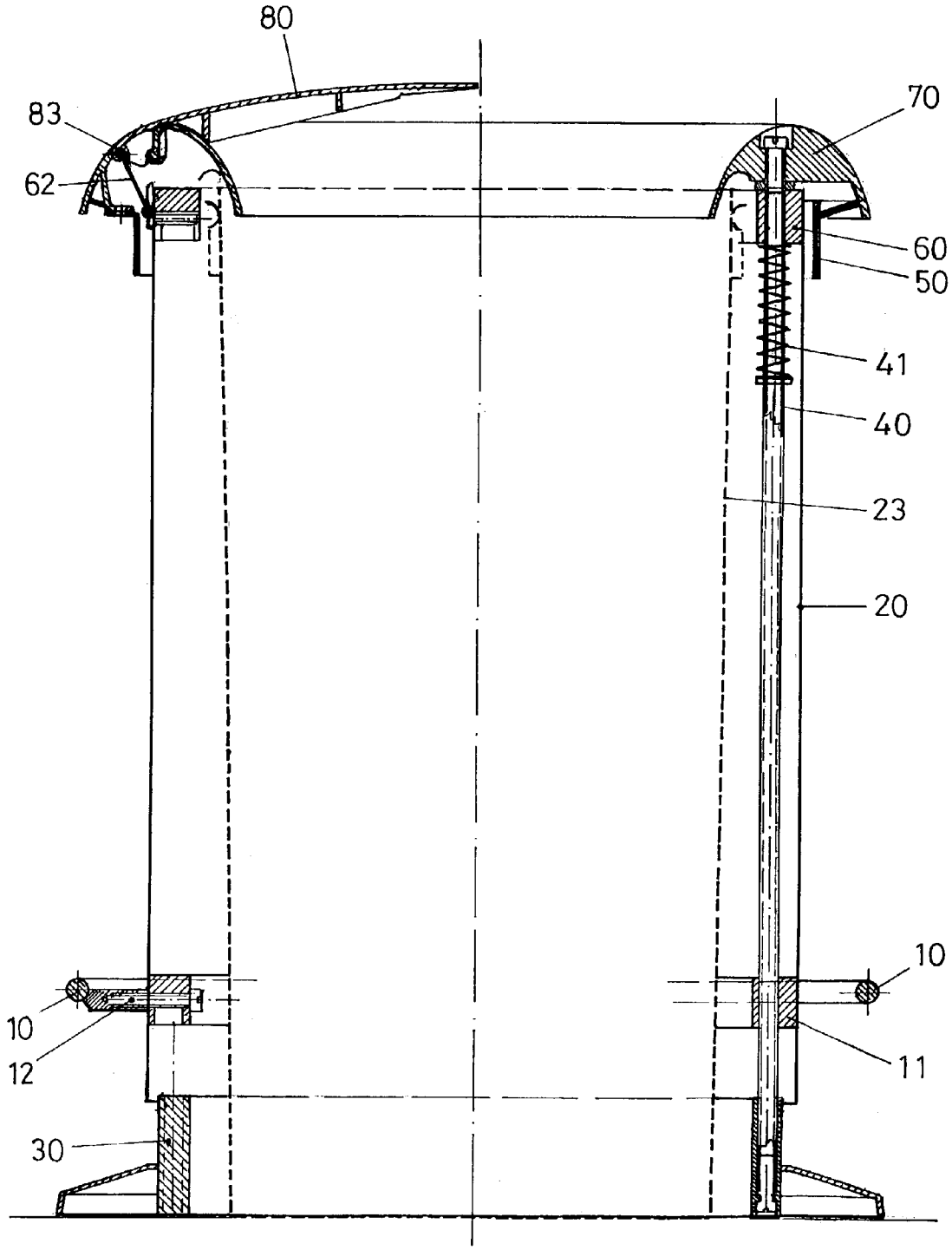
FIG. 3 shows a longitudinal sectional illustration through the refuse receptacle according to the invention in the raised initial position of the foot pedal.
Figure 4:
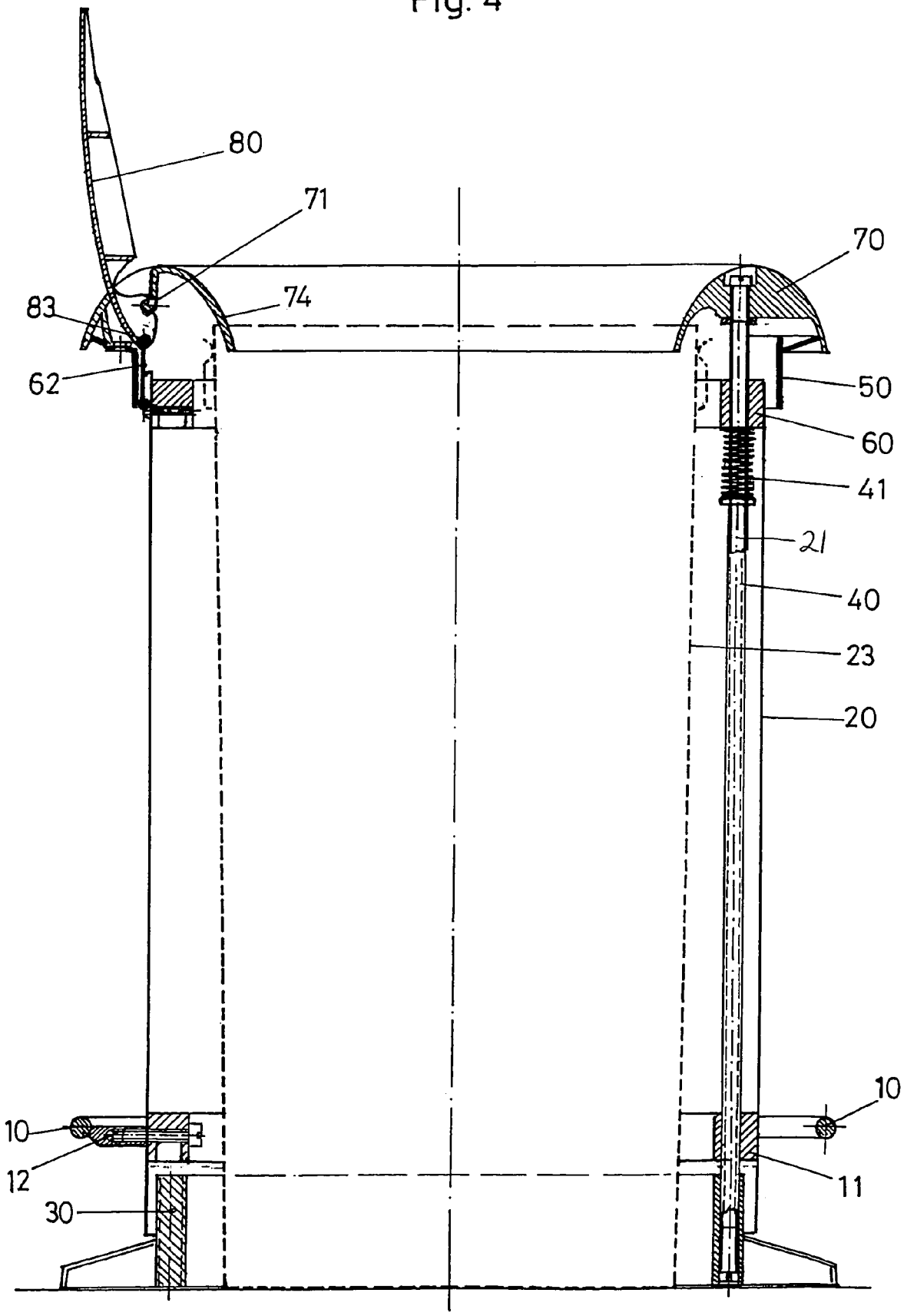
FIG. 4 shows a corresponding longitudinal sectional illustration with the foot pedal depressed and lid segments swung upward.

The previously described opening mechanism can readily be seen with reference to FIGS. 3 and 4 which show the two positions, FIG. 3 namely showing the initial position when the lid is closed and only one lid segment 80 of which is illustrated. FIG. 4 shows the corresponding position where the lid is opened. A comparison of the two illustrations reveals that the foot pedal 10 has been moved in FIG. 4 together with the outer housing 20 into the depressed position. It can also be seen that the outer housing 20 has been pushed in the lower region over the base 30. In both illustrations, the outer ring 70 has retained its position. It can readily be seen that the guide tubes 40 protrude both into the base 30 and into the outer ring 70. In the position according to FIG. 4, the compression springs 41 are stressed. In FIG. 4, the upper inner ring 60 has been depressed together with the outer housing 20. The lower inner ring 11 is likewise used for guiding and also fastening the foot pedal 10 during the depressing movement of the outer housing 20. As can be seen on the left-hand side in FIG. 3, the foot pedal can be secured to the lower inner ring 11 via screws 12, for example. In this case, these screws 12 can be screwed from the inside into corresponding drilled holes 13 (also see FIG. 1) of the foot pedal 10.

The inside bin 23 can also be seen in FIGS. 3 and 4, and it can be seen that the outer ring 70 engages with an inner collar 75 in the inside bin 23. After the outer ring 70 is removed, the inside bin 23 can be taken out upward. When the outer housing 20 is depressed, the inside bin 23 does not change its position, as FIGS. 3 and 4 show. The outer ring 70, like the covering ring 50, remains in its original position, which can readily be seen in the respective right-hand section both in FIG. 3 and in FIG. 4. In the respective left-hand half of the drawing of FIG. 3 and FIG. 4, a different sectional plane is illustrated in each case. In the respective left-hand half of the drawing, the lid segment 80, which is swung open in FIG. 4 can be seen as can the pivot axis 71 and one of the driver elements 62, which moves downward together with the upper inner ring 60. The point of articulation 83 of the driver element 62 on the lid segment 80, which point, in the initial position according to FIG. 3, lies further outward than the horizontal pivot axis 71 of the lid segment, can be seen. As can be seen in FIG. 4, the pulling movement of the driver element 62 has caused the point of articulation 83 to move downward.

Figure 5:
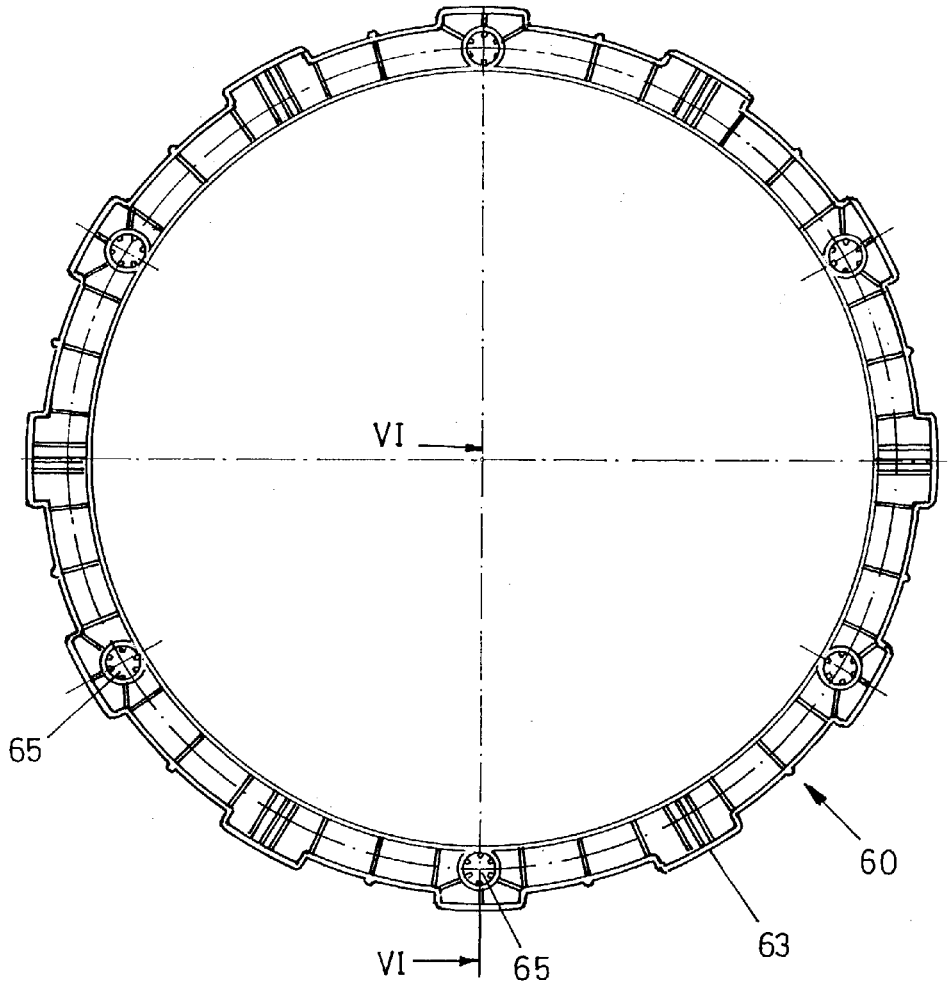
FIG. 5 shows a plan view of the upper inner ring 60.
Figure 6:
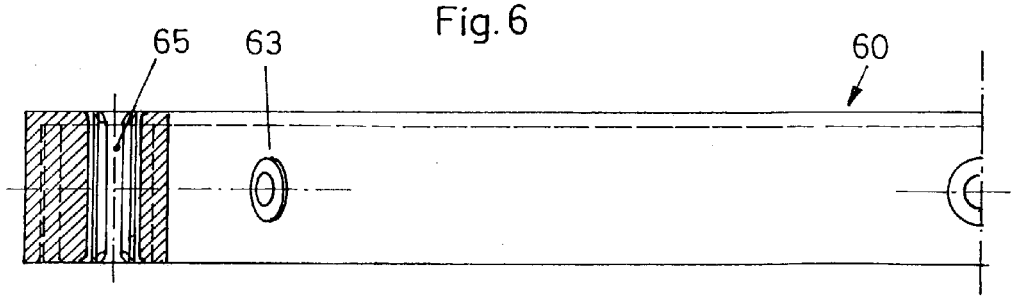
FIG. 6 shows a sectional view along the line VI—VI from FIG. 5 through the inner ring.

A number of further details of the inner ring 60 according to the invention emerge from FIGS. 5 and 6. In FIG. 5, the guide sleeves 65 which hold the guide tubes 40 (also see FIGS. 1, 3 and 4) can be seen particularly well. As emerges from FIGS. 3 and 4, the guide tubes 40 are guided respectively upward and downward by the two inner rings 60. As FIG. 5 shows, a total of six such guide sleeves 65 are arranged over the circumference of the inner ring 60. FIG. 6 also shows the holes 63 in the inner ring 60, into which the stem 64 of the retaining means 61 is inserted in each case, to which the driver elements 62 are fastened by their lower end 62*b* (also see FIG. 2). There may also be six holes 63 distributed over the circumference of the inner ring 60.

Figure 7:
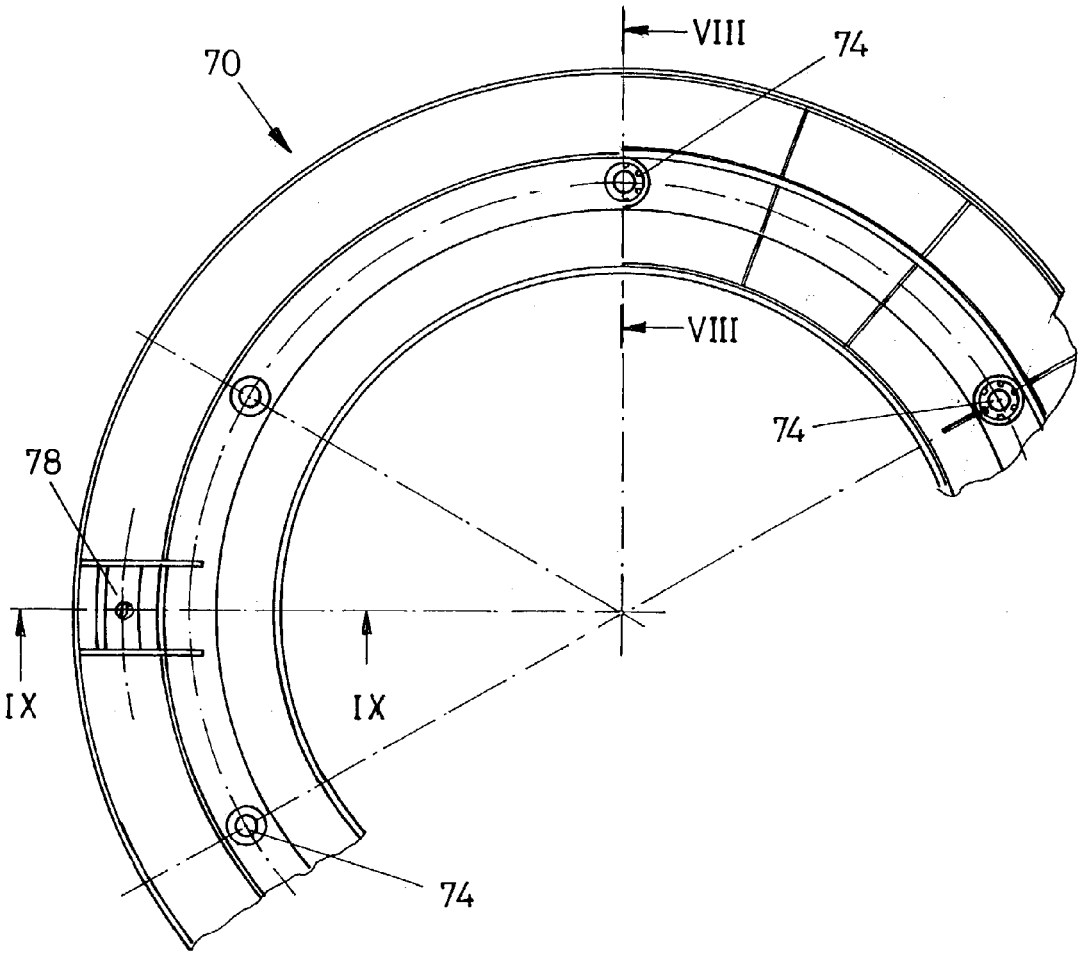
FIG. 7 shows a plan view of the outer ring.
Figure 8:
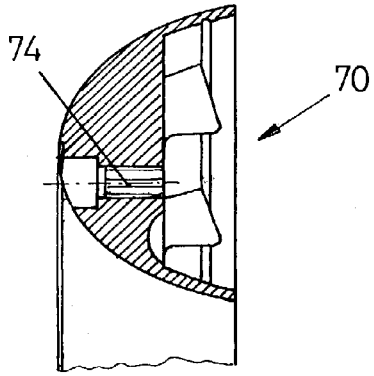
FIG. 8 shows a sectional view along the line VIII—VIII from FIG. 7 through the outer ring.

More specific details relating to the outer ring 70 emerge from FIGS. 7, 8 and 9 and will be explained in greater detail below. FIG. 7 shows a cutout of the outer ring 70 in plan view. The receiving sleeves 74, in which the covering caps 73, which are also illustrated in FIG. 2, are secured, can be seen in it. These covering caps 73 cover the upper end region 43 of the guide tubes 40 (also see FIG. 2). FIG. 8 shows a section through the outer ring 70 in the region of one such receiving sleeve 74. The guide tubes 40 can have an internal thread in their upper end regions 43 (see FIG. 1), with the result that the screws 76, which are illustrated in FIG. 2 and which engage in the receiving sleeves 48 illustrated in FIG. 8, can be used to secure the upper ends of the guide tubes 40 in the outer ring 70.

Figure 9:
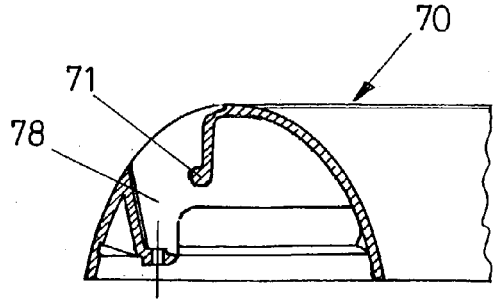
FIG. 9 shows a further section along the line IX—IX from FIG. 7 through the outer ring.
Figure 11:
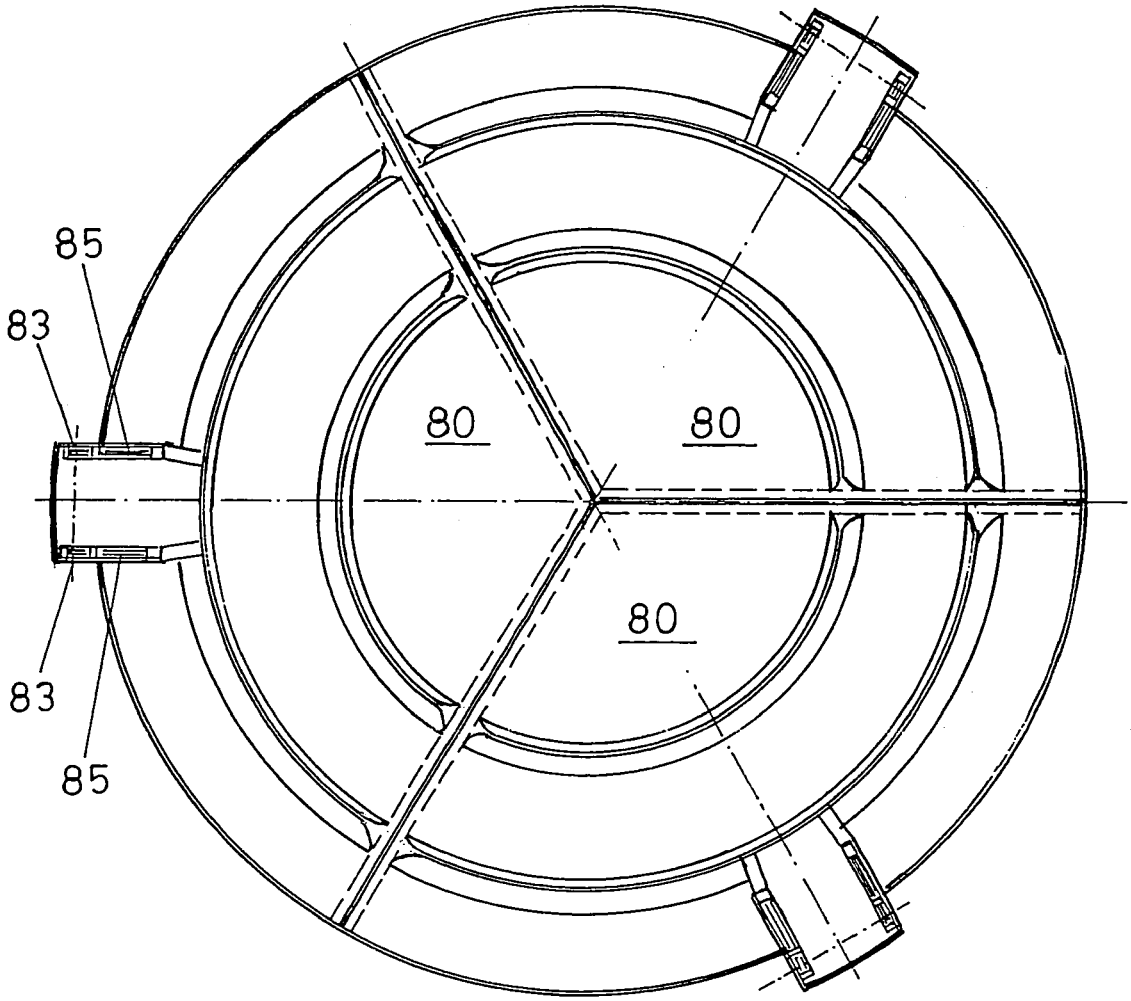
FIG. 11 shows a plan view of the bottom surface of the lid segments of the refuse receptacle.
Figure 12:
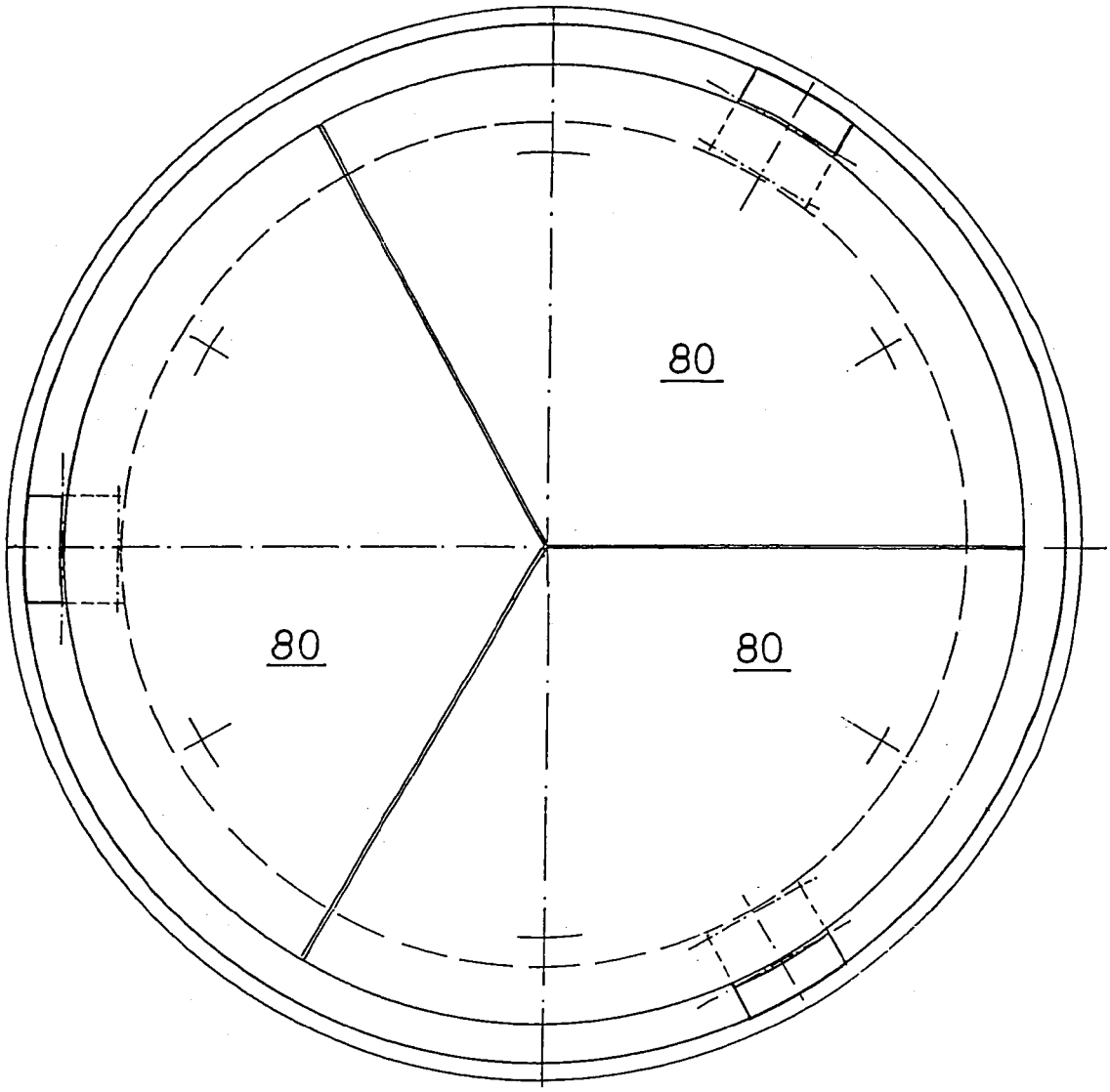
FIG. 12 is a plan view of the top surface of the lid segments of the refuse receptacle.

FIG. 9 shows a further section through the outer ring 70; specifically in the region in which the articulated attachment of the lid segments 80 to the outer ring 70 takes place. Since, in the exemplary embodiment, a total of three such lid segments 80 are attached to the outer ring 70, the outer ring 70 has three such fastening devices. FIG. 9 shows the point at which the pivot axis 71 for the lid segment 80 is situated (also see FIG. 4). FIG. 11 shows a view of a lid segment 80 seen from the lower side. This shows the joint formations 85 in the form of double webs on which the points of articulation 83, which can be seen in FIG. 3, for the driver elements 62 are also situated. The joint formations 85 of the lid segments 80 engage in the joint holders 78 of the outer ring, which holders can be seen in FIG. 9 and also FIG. 7. Double webs 79, which are added to the double webs 85 of the joint formations of the lid segments 80 to form a hinge-like joint, are likewise situated on the outer ring 70, in a position further inward toward the joint holders 78.

Figure 10:
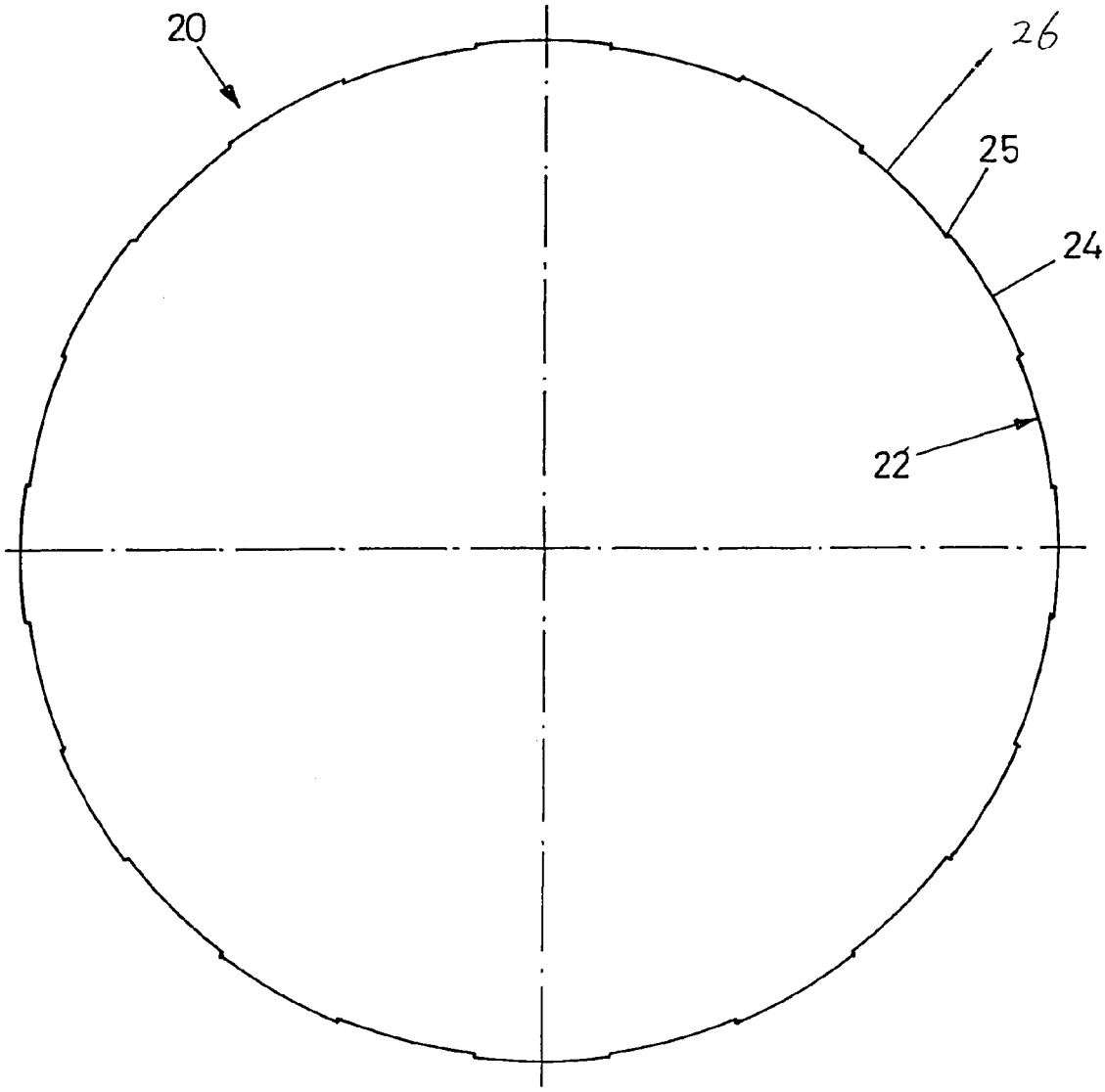
FIG. 10 shows a plan view of the outer casing of the refuse receptacle.

FIG. 10 shows a plan view of the outer housing 20, from which it can be seen that it is a type of casing, for example made from sheet metal having a relatively thin material thickness. For stabilization purposes, the wall 22 of the outer housing is provided with beads 26 which alternate, as seen over the circumference, in each case with projecting regions 24, with it being possible for slopes 25 to be provided in the transition regions, with the result that, for example, a cross section similar to a sheet with trapezoidal corrugations is produced.

LIST OF REFERENCE NUMBERS

10 Foot pedal
11 Inner ring
12 Screws
13 Drilled holes
20 Outer housing
21 Guide rods
22 Outer walls
23 Inside bin
24 Projecting region
25 Slopes
26 Beads
30 Base
31 Cylindrical stem
32 Drilled holes
40 Guide tubes
41 Springs
42 End region
43 Upper end regions
48 Receiving sleeves
50 Covering ring
51 Collar
60 Inner ring
61 Retaining means
62 Driver elements
62*b* Lower end
63 Holes
64 Stem
65 Guide sleeves
70 Outer ring
71 Pivot axis
72 Groove
73 Covering caps
74 Receiving sleeves
75 Inner shoulder
76 Screws
78 Joint holders
79 Double webs
80 Lid segments
81 Formations
82 Joint formations
83 Points of articulation
85 Double webs

What is claimed is:

1. A refuse receptacle having an outer housing with a lid closing an insertion opening in an upper region of said outer housing, comprising a foot pedal attached to the refuse receptacle and the actuation of which enables the lid of the refuse receptacle to be moved into an opening position, the foot pedal being arranged in the lower region of the outer housing, wherein the foot pedal is depressed in a linear movement to open the lid, and wherein the outer housing is depressed together with the foot pedal, wherein the outer housing is depressed linearly counter to the force of restoring springs, which are stressed when the outer housing is depressed and function as a spring loaded cylinder for the corresponding return movement of the outer housing to its initial position.

2. The refuse receptacle as claimed in claim 1, wherein guide means are provided which ensure a guided, linear movement when the outer housing of the refuse receptacle is depressed.

3. The refuse receptacle as claimed in claim 2, wherein the guide means comprise guide sleeves in the outer housing and guide rods within the guide sleeves.

4. The refuse receptacle as claimed in claim 3, wherein the guide rods extend between a base and an outer ring.

5. The refuse receptacle as claimed in claim 1, wherein said refuse receptacle has a base and the outer housing is displaced relative to this base.

6. The refuse receptacle as claimed in claim 1, wherein the foot pedal is an annular foot pedal fastened to the outer housing and surrounding said outer housing at a distance on all sides.

7. The refuse receptacle as claimed in claim 1, wherein fastening means comprising an inner ring attached in the outer housing is provided for fastening the foot pedal to the outer housing.

8. The refuse receptacle as claimed in claim 2, wherein compression springs which are arranged in the region of the guide means of the outer housing are used as the restoring springs.

9. The refuse receptacle as claimed in claim 1, wherein said refuse receptacle further comprises a covering ring pushed over the upper region of the outer housing.

10. The refuse receptacle as claimed in claim 9, wherein an outer ring is placed onto the outer housing and to which the lid is fastened in an articulated manner.

11. The refuse receptacle as claimed in claim 9, wherein the covering ring has means for the form-fitting or frictional connection to an outer ring, which ends the outer housing on the upper region.

12. The refuse receptacle as claimed in claim 10, wherein the outer ring is connected to the covering ring via fastening elements.

13. The refuse receptacle as claimed in claim 10, wherein the covering ring has a collar, which engages a groove of the outer ring.

14. The refuse receptacle as claimed in claim 1, wherein an inner ring connected in the upper region to the outer housing of the refuse receptacle, is provided with retaining means to which driver elements are attached, said driver elements, when the outer housing of the refuse receptacle is depressed, exerting a tensile force on the lid, with the result that the lid pivots into an opening position.

15. The refuse receptacle as claimed in claim 14, wherein the lid is attached, in a manner such that it can pivot about an axis, to an outer ring ending the upper region of the outer housing of the refuse receptacle.

16. The refuse receptacle as claimed in claim 2, wherein parts of the guide means are secured in a fixed manner on an upper end in an outer ring when the outer housing of the refuse receptacle is depressed.

17. The refuse receptacle as claimed in claim 15, wherein points of articulation of the driver elements on the lid lie at a distance from the pivot axis of the lid.

18. The refuse receptacle as claimed in claim 1, wherein the lid comprises lid segments.

* * * * *